US006895940B2

(12) United States Patent
Igashira

(10) Patent No.: US 6,895,940 B2
(45) Date of Patent: May 24, 2005

(54) HYDRAULIC CONTROL DEVICE, SYSTEM AND METHOD FOR CONTROLLING ACTUATOR DEVICE

(75) Inventor: Toshihiko Igashira, Toyokawa (JP)

(73) Assignee: Denso Corporation (JP)

( * ) Notice: Subject to any disclaimer, the term of this patent is extended or adjusted under 35 U.S.C. 154(b) by 104 days.

(21) Appl. No.: 10/028,905

(22) Filed: Dec. 28, 2001

(65) Prior Publication Data

US 2002/0117149 A1 Aug. 29, 2002

(30) Foreign Application Priority Data

Dec. 28, 2000 (JP) ..... 2000-400227
Jun. 28, 2001 (JP) ..... 2001-196626

(51) Int. Cl.[7] ..... F02M 5/00

(52) U.S. Cl. ..... 123/472; 123/480; 123/475; 123/478

(58) Field of Search ..... 123/400, 472, 123/488, 475, 478

(56) References Cited

U.S. PATENT DOCUMENTS 4,495,921 A * 1/1985 Sawamoto ..... 123/438
4,551,803 A * 11/1985 Hosaka et al. ..... 701/105
5,575,264 A 11/1996 Barron
5,634,448 A * 6/1997 Shinogle et al. ..... 123/480

FOREIGN PATENT DOCUMENTS

| | | |
|---|---|---|
| DE | 19700711 | 9/1998 |
| EP | 0937891 | 8/1999 |
| EP | 1000240 | 5/2000 |
| FR | 0199632 | 10/1986 |
| JP | 07238857 | 9/1995 |
| JP | 7-332142 | 12/1995 |
| WO | WO 99/61779 | 12/1999 |

* cited by examiner

*Primary Examiner*—Bibhu Mohanty
(74) *Attorney, Agent, or Firm*—Nixon & Vanderhye PC

(57) ABSTRACT

A supplying unit supplies energy to an actuator so that the supplied energy is kept therein, making displacement the actuator. An interrupting unit interrupts the supply of energy to cause the actuator to discharge the kept energy, making displacement the actuator. A converting unit is adapted to convert the displacement of the actuator corresponding to the kept energy into hydraulic pressure applied to the valve member, moving the valve member to open the low pressure port and close the high pressure port. The convert unit converts the displacement of the actuator corresponding to the discharged energy into hydraulic pressure applied to the valve member, moving the valve member to open the high pressure port and close the low pressure port. Energy which the actuator requires to move the valve member so as to close the high pressure port is larger than energy which the actuator requires to move the valve member so as to open the low pressure port.

4 Claims, 8 Drawing Sheets

HYDRAULIC CONTROL DEVICE, SYSTEM AND METHOD FOR CONTROLLING ACTUATOR DEVICE

BACKGROUND OF THE INVENTION

1. Field of the Invention

The present invention relates to an actuator device, such as a hydraulic control device, in which an actuator is installed, a control system and a method for the actuator device.

More particularly, the present invention relates to an actuator device, such as a hydraulic device, applied to, for example, an internal combustion engine, such as a diesel engine, a control system and a method for the actuator device.

2. Description of the Related Art

Conventional actuators that energization can make operate include an actuator, such as a piezoelectric actuator, a magnetostrictive actuator, or the like, which deforms according to amount of energy based on the energization and kept by itself, thereby generating driving force, such as pressing force. Conventional actuator devices in each of which the above actuator is installed, such as, hydraulic control valves, fuel injectors and so on, are proposed.

The actuator devices are applied to, for example, a common-rail fuel injection system of a diesel engine. The actuator of each actuator device is used for generating driving force to a needle for changing the fuel injection system between a state of injecting fuel and that of stopping the injection of fuel.

The actuator of each actuator device applied as a hydraulic control valve to a common-rail fuel injection system of a diesel engine is also used for driving a valve member so as to control a fuel pressure in a back pressure chamber formed in a back side of the needle, thereby changing a displacement of the needle.

With the actuator device applied as the hydraulic control valve, the valve member is configured to close one of a high pressure port communicated with a pressure accumulator referred to as "common rail" and a low pressure port communicated with a drain passage, thereby controlling a fuel pressure in the back pressure chamber, which is supplied as high pressure to the needle.

That is, the actuator operates so that the valve member makes open the low pressure port and close the high pressure port, causing the fuel pressure in the back pressure chamber to drop, thereby lifting the needle. The lifting operation of the needle causes the fuel to be injected through an injection hole of the hydraulic control valve. The actuator also operates so that the valve member makes open the high pressure port and close the low pressure port, causing the pressure in the back pressure chamber to rise again. The rise of the back pressure causes the needle to drop, thereby interrupting the injection of fuel.

In these fuel injection systems, the actuator operates so as to change the driving force or the fuel pressure with respect to the needle, so that the injection timing of fuel or injection quantity thereof is determined by the changing timing of the actuator's operation. An ECU (Electric Control Unit) controls the changing timing of the actuator's operation.

In the described common-rail fuel injection system, in order to carry out the fuel injection according to the operating state of the engine, it is important to improve the controllability of a fuel injection pressure (common rail pressure) and a fuel injection rate (fuel injection quantity unit of time). The quantity of fuel delivered to the common rail by a high-pressure pump usually controls the common rail pressure, and a special depressurization valve provided for the common rail controls the common rail pressure according to the abruptly requirement of depressurizing the common rail pressure. Recently, however, it is examined to carry out the depressurization control through the hydraulic control valve without providing the special depressurization valve. This depressurization control can be performed by moving the valve member of the hydraulic control valve up to a middle (half) position between the low pressure port and the high pressure port, causing the fuel in the common-rail to be relieved. In addition, the hydraulic control valve permits the valve member to be located between the low pressure port and the high pressure port, making it possible to easily control the pressure in the back pressure chamber. It is expected to accurately inject a small amount of fuel and to improve the performance of the fuel injection system.

Variations of the performances of actuator devices are generated among each other due to the unevenness among the designs or qualities of the manufactured actuator devices.

Even when, therefore, energizing the actuators of the actuator devices at the same timing, the timings of fuel injections of the actuator devices or the quantities of fuel thereof, which are injected therefrom, are relatively different from each other, so that it is impossible to completely handle a requirement for decreasing exhaust gases in recent years and other similar requirements. Then, one approach for solving the problem related to the variations of the actuator devices is disclosed.

That is, as described in the U.S. Pat. No. 5,634,448, this approach is to previously measure injection characteristics of the injectors, respectively, so as to correct, according to the measured injection characteristics, operating parameters of each of the actuators of the injectors, operator parameters which determine the operation timing and the operation time of each of the actuators thereof. The offset values of the operator parameters are written onto a memory or the like of the ECU so that the ECU reads the offset parameters from its memory. The writing of the offset value onto the memory or the like is performed by scanning the offset value which is bar-coded to the corresponding injector to which the measurement of the offset value is already completed, thereby writing the scanned offset value onto the memory.

However, the above conventional fuel injection system requires the great energy to lift from the low pressure port the valve member subjected to the fuel pressure in the high pressure port. In addition, when the valve member once lifts, the fuel pressure is also applied to the valve member in the lifting direction. The requirement of the great energy and the application of the fuel pressure in the lifting direction make it extremely difficult to control stably the valve member so as to keep it at a half-lift position between the low pressure port and the high pressure port.

In the present circumstances, therefore, it is hard to carry out the half-lift control of the valve member in the conventional fuel injection system to which the hydraulic control valve with the above described configuration is applied.

In addition, in cases where the operating characteristics of actuators themselves determine the operating conditions of some actuator devices in which the actuators are installed, respectively, the operating conditions of some actuator devices do not very vary among each other. In cases where each of other actuator devices has a complicated configuration, such as the above injector, or each of which contains hydraulic pressure interposed between the actuator and the valve member or the needle, the operating conditions of the other actuator devices easily vary among each other.

For example, in a part of injectors, the pressing force of the actuator required for moving the valve member or the needle away from the position at which the valve member or the needle is seated is relatively insufficient, causing the seat of the valve member or the needle to be instable. In this case, it is considered to set the quantity of energy delivered to the actuator to sufficiently great one enough for the movement of the valve member or the needle away from the seated position, making it possible to secure the pressing force required for the movement of the valve member or the needle.

However, in some actuator devices, such as engines performing a greatly number of fuel injections, whose actuators frequently operate, delivering excessively great quantity of energy to the actuators causes a heavy energy loss. Moreover, delivering excessively great quantity of energy to the actuators also causes heat generation in some actuator devices, and causes excessive wear of each component of some actuator devices to be accelerated. These problems bring about variations of the injection characteristics of the injectors with time, so that even when adopting the techniques described in the U.S. Pat. No. 5,634,448 to the actuator device, it is not necessarily to perform fuel injection with a high degree of accuracy.

SUMMARY OF THE INVENTION

The present invention is directed to overcome the foregoing problems. Accordingly, it is an object of the present invention to provide a hydraulic control device capable of controlling stably a valve member so as to keep it at a half-lift position, thereby improving the controllability of injection rate of fuel injection system, that of decompression control of a common-rail or the like.

It is another object of the present invention to provide a system and a method for an actuator device, which are capable of controlling simply energy delivered to an actuator so as to set it to suitable energy.

In order to achieve at least one of the objects or other objects, according to one aspect of the present invention, there is provided a hydraulic control valve in which an actuator is installed, comprising a housing forming therein a control chamber, a high pressure passage in which a high pressurized fuel is supplied, a high pressure port communicated with the control chamber and the high pressure passage, a law pressure passage and a law pressure port communicated with the control chamber and the low pressure passage; a valve member interposed between the high pressure port and the low pressure port to be movable therebetween, the valve member being affected by a pressure in the control chamber; means for supplying energy to the actuator so that the supplied energy is kept therein, thereby making displacement the actuator; means for interrupting the supply of energy so as to cause the actuator to discharge the kept energy, thereby making displacement the actuator; and converting means operatively connected to the actuator and the valve member, and adapted to convert the displacement of the actuator corresponding to the kept energy into hydraulic pressure applied to the valve member, thereby moving the valve member so as to open the high pressure port and close the high pressure port, the converting means converting the displacement of the actuator corresponding to the discharged energy into hydraulic pressure applied to the valve member, thereby moving the valve member so as to open the high pressure port and close the low pressure port, wherein energy which the actuator requires to move the valve member so as to close the high pressure port is larger than energy which the actuator requires to move the valve member so as to open the low pressure port.

According to one aspect of the present invention, when supplying energy that the actuator requires to move the valve member so as to open the low pressure port, the actuator makes move (lift) the valve member toward the high pressure port. The supplied energy, however, is smaller than energy which the actuator requires to move the valve member so as to close the high pressure port so that it is impossible to close the high pressure port by the valve member. That is, setting the energy supplied to the actuator to suitable energy smaller than the energy required to close the high pressure port permits the valve member to be kept at a half lift position between the low pressure port and the high pressure port, making it possible to stably control a lift amount of the valve member being moved to the half lift position by an amount of energy supplied to the actuator or a voltage supplied thereto.

In order to achieve at least one of the objects or other objects, according to another aspect of the present invention, there is provided a control system for controlling a plurality of actuator devices in each of which an actuator is installed, the actuator being deformed according to an amount of energy, the energy being kept in the actuator by energization, the control system comprising: means for storing thereon individual data each specifying a condition of the energization of each of the actuator devices, the condition of the energization permitting energy to be supplied to each of the actuator devices, the energy being required for making each of the actuator devices a predetermined operating state; and means for setting the condition of energization to each of the actuator devices according to each of the stored individual data.

In preferred embodiment of this another aspect, the setting means is operative to convert the individual data into actual data according to a difference between an actual operating condition of each of the actuator devices and a reference operating condition thereof, the actual data corresponding to the actual operating condition of each of the actuator devices.

In order to achieve at least one of the objects or other objects, according to further aspect of the present invention, there is provided a method of controlling a plurality of actuator devices in each of which an actuator is installed, the actuator being deformed according to an amount of energy, the energy being kept in the actuator by energization, the control system, the method comprising: storing on a memory individual data each specifying a condition of the energization of each of the actuator devices, the condition of the energization permitting energy to be supplied to each of the actuator devices, the energy being required for making each of the actuator devices a predetermined operating state; and setting the condition of energization to each of the actuator devices according to each of the stored individual data.

According to another and further aspects of the present invention, the individual data each specifying a condition of the energization of each of the actuator devices are stored on the storing means and the condition of the energization permits energy to be supplied to each of the actuator devices, the energy being required for making each of the actuator devices a predetermined operating state.

Therefore, the condition of energization to each of the actuator devices is set according to each of the stored individual data.

As a result, even if the individual differences of the actuator devices occur, it is possible to prevent the variations of the actuator devices, the loss of the energy and the variation of the injection characteristic over time due to wear.

In addition, according to the preferred embodiment of this another aspect of the present invention, even if the actual operating conditions vary, it is possible to set the condition of energization corresponding to the varied operating conditions, condition of energization which permits energy to be supplied to each of the actuator devices, the energy being required for making each of the actuator devices the predetermined operating state under the varied operating conditions.

BRIEF DESCRIPTION OF THE DRAWINGS

Other objects and aspects of the present invention will become apparent from the following description of embodiments with reference to the accompanying drawings in which.

DETAILED DESCRIPTION OF THE EMBODIMENTS

The embodiments of the present invention will be described hereinafter with reference to the accompanying drawings.

First Embodiment

Figure 1:
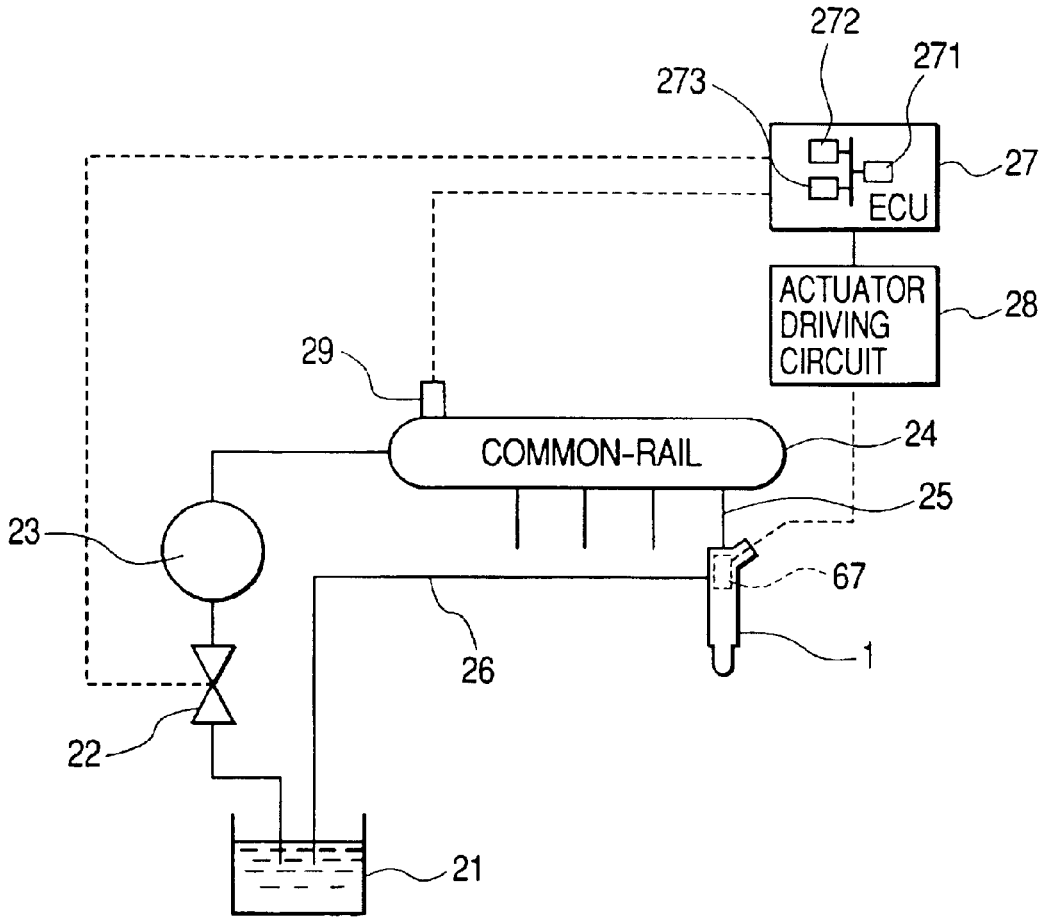
FIG. 1 is a view showing a configuration of a common-rail fuel injection system to which a first embodiment of the present invention is applied.

FIG. 1 shows a configuration of a common-rail fuel injection system to which a first embodiment of the present invention is applied.

The common-rail fuel injection system comprises injectors (fuel injection valves) 1 for respective cylinders of the common-rail fuel injection system. A number of injectors correspond to that of cylinders of the common-rail fuel injection system. Incidentally, in FIG. 1, one injector 1 is only shown.

The injector 1 is communicated through a delivery line 25 with a common-rail 24, which is common among the cylinders. The injector 1 is subjected to the fuel delivered from the common-rail 24 so as to inject fuel at an injection pressure into a combustion chamber of the corresponding cylinder, injection pressure which is substantially equal to a fuel pressure in the common-rail 24.

Fuel in a fuel tank 21 is delivered by the pressure of a high-pressure pump 23 to a common-rail 24 so as to be accumulated therein at a high pressure.

Fuel delivered from the common-rail 24 to the injector 1 also serves as a hydraulic pressure for controlling the injector 1, in addition to the injection into the combustion chamber. The fuel delivered to the injector 1 reflows through a drain line 26 into the fuel tank 21 as a low-pressure source.

Figure 2A:
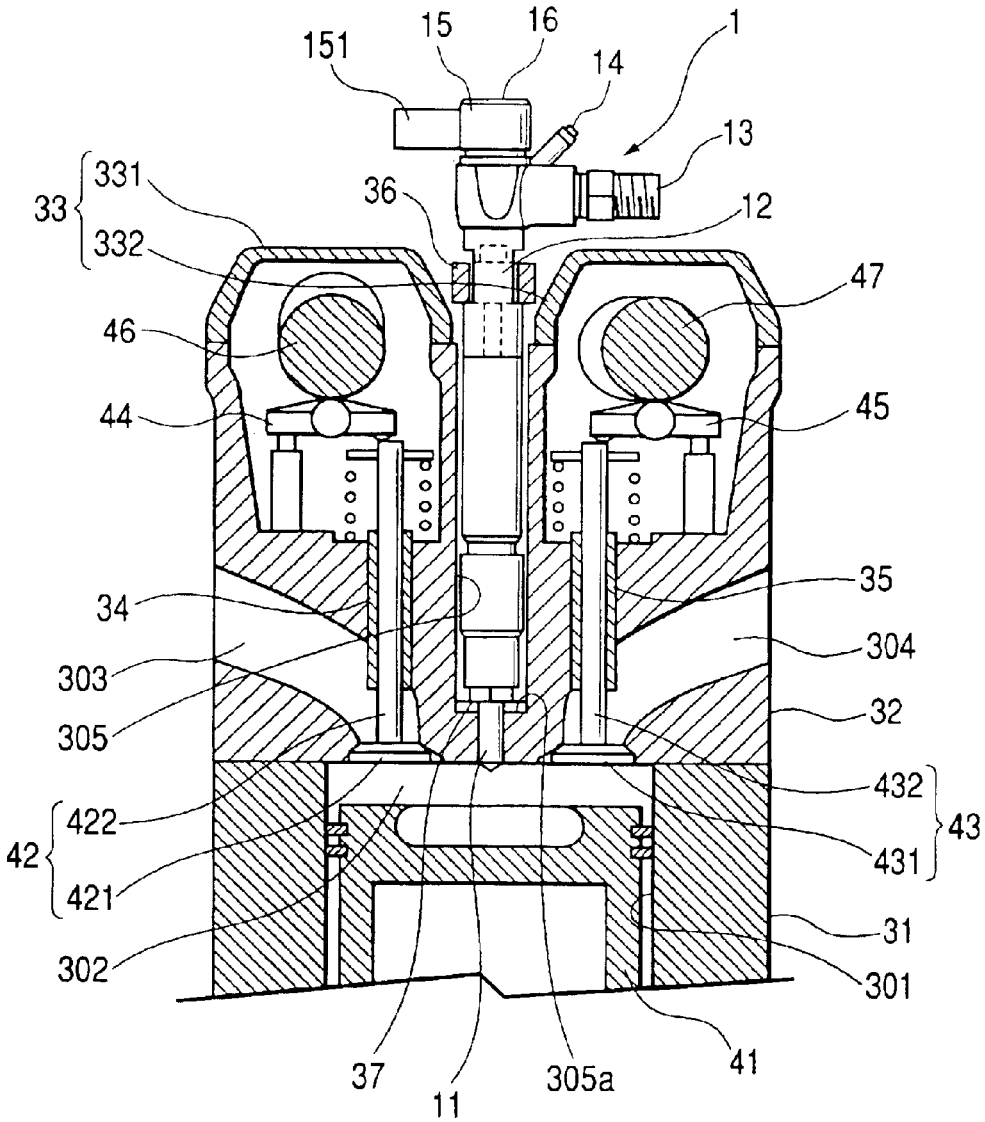
FIG. 2A is a view showing a configuration of a main part of an engine body of the fuel injection system, to which the injector shown in FIG. 1 is installed according to the first embodiment.
Figure 2B:
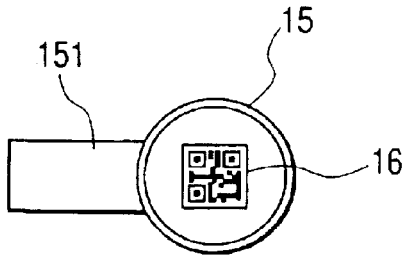
FIG. 2B is an enlarged view showing a connector portion, a QR code pattern and a connection port of the engine body shown in FIG. 2A.

FIG. 2A and FIG. 2B show a configuration of a main part of an engine body of the injection system, in which the injector 1 is installed. The engine body is provided with a cylinder block 31 and a cylinder head 32 mounted on a top portion of the cylinder block 31 so that the top portion thereof is covered with the cylinder head 32. A piston 41 is held in a cylinder 301 formed in the cylinder block 31 so as to be slidable.

A combustion chamber 302 is formed between the piston 41 and the cylinder head 32. The cylinder head 32 is formed with an intake port 303 communicated with an intake manifold and an exhaust port 304 communicated with an exhaust manifold. An intake valve 42 is provided in the cylinder head 32 for changing the intake port 303 between a state of being communicated with the cylinder 301 and that of being interrupted thereto. An exhaust valve 43 is also provided in the cylinder head 32 for changing the exhaust port 304 between a state of being communicated with the cylinder 301 and that of being interrupted thereto.

Each of the intake valve 42 and the exhaust valve 43 is designed to be openable from the outside thereof, and comprises an umbrella head and a tubular stem. The intake port 303 and the exhaust port 304 are formed at their upper wall portions with tubular guide members 34, 35, respectively, so that the tubular guide members 34, 35 are penetrated through the upper wall portions. Each of the stems of the intake valve 42 and the exhaust valve 43 is inserted in each of the guide members 34, 35 so as to project above the cylinder head 32.

Valve drive units 44 and 45 are mounted on the cylinder head 32 and operative to drive the intake valve 42 and the exhaust valve 43 to open or close them. Power delivered from cam shafts 46, 47 makes operate the valve drive units 44, 45.

A head cover member 33 is mounted on a top portion of the cylinder head 32 so as to cover thereof. The head cover member 33 is provided with two cover elements 331, 332 which are long in axial directions of the cam shafts 46, 47. The cover element 331 covers the valve drive unit 44 for the intake valve 42 and the cam shaft 46, and the cover element 332 covers the valve drive unit 45 for the exhaust valve 43 and the cam shaft 47.

The cylinder head 32 is formed at its center portion with an installation hole 305, center portion which is interposed between the valve drive unit 44 and valve drive unit 45. The installation hole 305 is penetrated vertically through the cylinder head 32 so that the injector 1 is installed in the installation hole 305. The installation hole 305 is formed at its bottom end portion with a stepped portion 305*a* with a small diameter. The injector 1 is formed with one tip end portion having a small diameter.

When inserting the injector 1 from its one tip end portion into the installation hole 305, the injector 1 is seated to be positioned by the stepped portion 305*a* of the installation hole 305 and the only one tip end portion of the injector 1 projects in the combustion chamber 302. A gasket 37 is mounted on the stepped portion 305*a* on which the injector 1 is seated so as to keep the airtight in the combustion chamber 301.

The injector 1 is also provided with a projection portion 12 projecting through the top portion of the cylinder head 32 and supported by a clamp 36.

In addition, the injector 1 is provided with an inlet portion 13 for receiving the delivered fuel to the injector 1, and a return portion 14 for recovering excess fuel, so that the inlet portion 13 and return portion 14 are arranged to laterally extend. The injector 1 is provided at its top with a connector portion 15. The connector portion 15 is made of, for example, a resin mold, and provided at its side portion with a connection port 151 laterally projecting therefrom. The connection port 151 is adapted to connect to a plug disposed to an end portion of a wire extending from an actuator driving circuit 28, referred to FIG. 1.

As shown in FIG. 2B, a QR (Quick Response) code pattern 16 is formed on a top surface of the connector portion 15. The QR code pattern 16 is one of two-dimensional code patterns and can be printed with a laser marking device or other similar devices. The QR code pattern 16 can be read with an optical scanner or other similar device that is described hereinafter.

Figure 3:
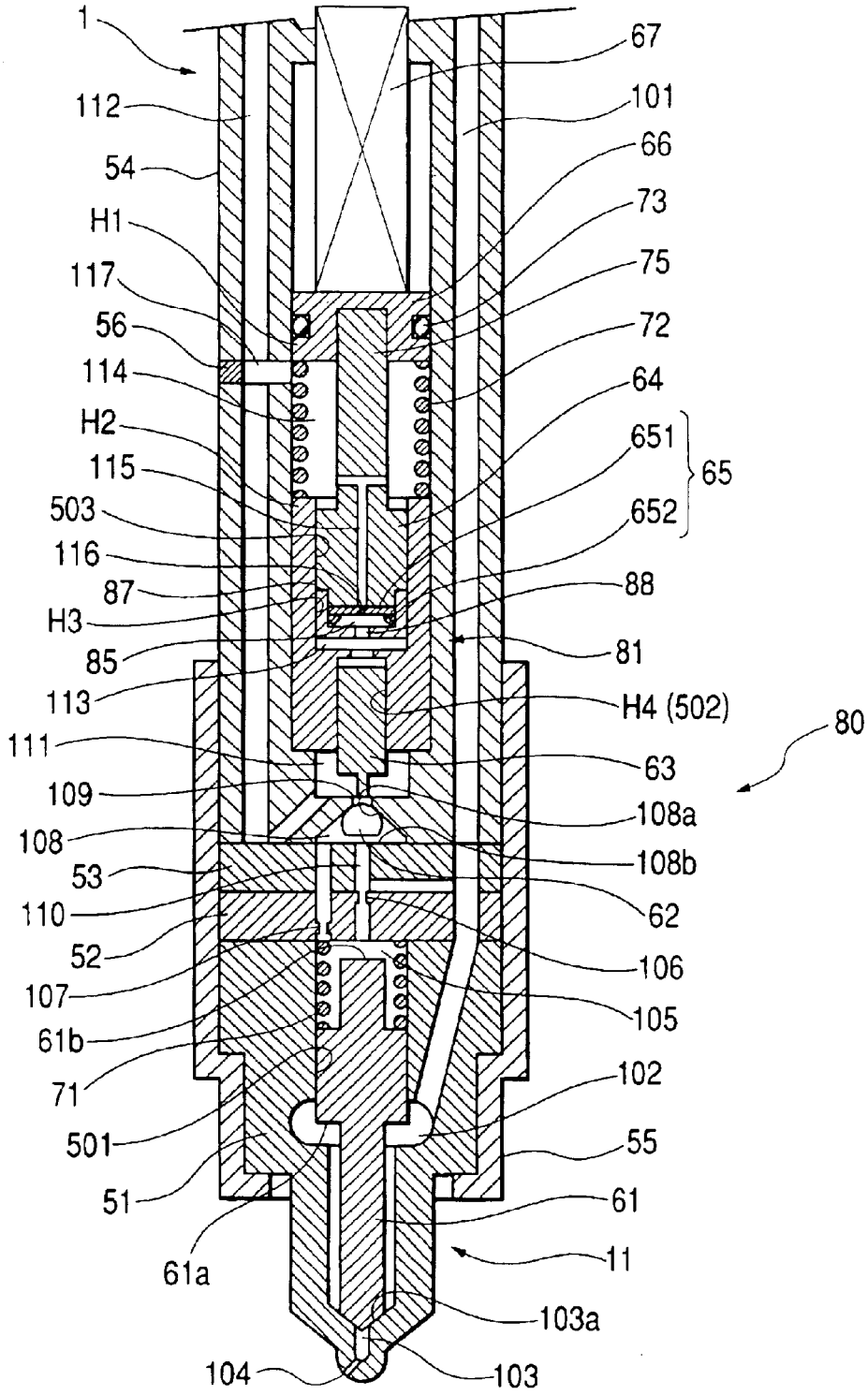
FIG. 3 is a cross sectional view of the injector shown in FIG. 1 according to the first embodiment.

FIG. 3 shows a sectional view of the injector 1. The injector 1 comprises a plurality of housing members 51, 52, 53, 54 and a retainer 55. Each of the housing members 51–54 has a substantially cylindrical or disc shape. The housing members 51, 52, 53 and 54 are laminated along their axial directions so as to be integrated with the retainer 55, forming, inside of the integrated housing members 51–54, spaces, one of which provides a passage 101 for fuel and so on, another one of which is to contain a needle 61 or the like.

That is, the housing member 51 which is positioned at the bottom side in the housing members 52–54 is a nozzle body, and the housing members 52 and 53 are orifice plates. The housing member (nozzle body) 51 is arranged on a bottom side of the housing member 54 through the housing members (orifice plates) 52 and 53. The housing members 51–54 are fixed with the retainer 55 so as to keep the oiltight in the housing members 51–54.

The housing member 51 is formed with a guide hole 501, a suck portion 103 and an injection hole 104. A top portion of the guide hole 501 is closed with the housing member 52, and a bottom portion of which is communicated with the suck portion 103. The suck portion 103 is communicated with the injection hole 104.

The injector 1 also includes a needle 61 contained in the guide hole 501. The needle 61 is provided with a large diameter portion and a small diameter portion arranged to a lower side of the large diameter portion, whose diameter is small as compared with the large diameter portion, whereby a circular stepped portion 61*a* is formed on a bottom side of the large diameter portion and an upper side of the small diameter portion. The small diameter portion of the needle 61 has a substantially circular rod shape.

The large diameter portion of the needle 61 is slidably supported in the guide hole 501 so that the needle 61 can displace within a range determined by a difference between the axial length of the needle 61 and that of the guide hole 501. That is, when the needle 61 is positioned at the lower end position within the range, the needle 61 is seated on a nozzle seat 103*a* formed on a top of the suck portion 103, causing the suck portion 103 to be closed.

The guide hole 501 is formed with an annular fuel accumulator 102 so as to surround an outer periphery of the needle 61. A high pressure passage 101 is communicated with the fuel accumulator 102 and extends upwardly through the housing members 52, 53 and 54, thereby being communicated with the common-rail 24.

Pressurized fuel is delivered from the common-rail 24 into the high pressure passage 101, and the delivered fuel is applied to the circular stepped portion 61*a* of the needle 61, urging constantly the needle 61 upwardly. Lifting the needle 61 causes the suck portion 103 to be opened, thereby injecting the delivered fuel through the suck portion 103 and the injection hole 104.

The injector 1 includes a coil spring 71 in the guide hole 501, which is arranged on an upper side of the needle 61. The coil spring 71 urges the needle 61 downwardly. The guide hole 501 is formed between the upper side of the needle 61 and the housing member 52 with a back pressure chamber (control chamber) 105 into which the pressurized fuel is constantly delivered from the high pressure passage 101 through a sub-orifice 106. The fuel pressure in the back pressure chamber 105 causes an upper end surface 61*b* of the needle 61 to be urged downwardly.

The injector 1 includes a hydraulic control valve 80 capable of changing a state of the fuel accumulated in the back pressure chamber 105. The hydraulic control valve 80 is formed on a lower side of the housing member 54. The hydraulic control valve 80 includes a valve chamber 108 communicated through a main orifice 107 with the back pressure chamber 105, and a substantially spherical valve member 62 arranged in the valve chamber 108.

The valve chamber 108 is formed at its conical top surface with a drain port 109 which is opening. The hydraulic control valve 80 also includes a high pressure port 110, a spill chamber 111 and a drain passage 112 as a low pressure passage for returning fuel. The drain port 109 is communicated through the spill chamber 111 and the drain passage 112 with the fuel tank 21. The valve chamber 108 is formed at its bottom surface with the high pressure port 110 which is opening and communicated with the high pressure passage 101 through a slot radially formed on the bottom surface of the housing member 53. The high pressure port 110 is arranged beneath the drain port 109.

The outer periphery of the opening portion of the drain port 109 facing to the valve chamber 108 forms a conical or annular drain seat 108*a*, and the outer periphery of the opening portion of the high pressure port 110 facing to the valve chamber 108 forms an annular high pressure seat 108*b*. The valve member 62 moves upwardly so as to be seated on the drain seat 108*a*, closing the drain port 109, and moves downwardly so as to be seated on the high pressure seat 108*b*, closing the high pressure port 110. One of the drain seat 108*a* and the high pressure seal 108*b* has a substantially flat shape because of permitting the valve member 62 to shift from an axial direction of the valve 80.

The close of the drain port 109 by the valve member 62 prevents the fuel from the back pressure chamber 105 from being exhausted and the fuel is delivered from the high pressure port 110 into the back pressure chamber 105, causing the fuel pressure in the back pressure chamber 105 to be increased to a high pressure which is substantially equal to the common-rail pressure. The increase of the fuel pressure in the back pressure chamber 105 makes the needle 61 downwardly, so as to be seated on the nozzle seat 103*a*.

On the other hand, the open of the drain port 109 by the valve member 62 makes close the high pressure port 110 so that the fuel in the back pressure chamber 105 reflows through the drain port 109 into the fuel tank 21. This decreases the fuel pressure in the back pressure chamber 105 to the fuel pressure determined according to an exhaust amount of fuel therefrom, which depends on a throttled amount of the sub-orifice 106 or the main orifice 107.

The throttled amount of the sub-orifice 106, that of the main orifice 107 or the like is set so that the downward urging force applied to the needle 61 is deteriorated than the upward force applied thereto when the high pressure port 110 is closed, permitting the needle 61 to be lifted.

Incidentally, the back pressure chamber 105 is constantly communicated with the high pressure passage 101 through the sub-orifice 106 instead of the valve chamber 108 and the valve member 62. The sub-orifice 106 permits, at the start of injection, the fuel to flow from the high pressure passage 101 into the back pressure chamber 105, causing the decrease of the pressure in the back pressure chamber 105 to be relaxed, thereby gradually opening the needle 61. At the stop of injection, the sub-orifice 106 permits the increase of the pressure in the back pressure chamber 105 to be accelerated, thereby rapidly closing the needle 61.

Next, a driving unit 81 for the hydraulic control valve la is described hereinafter.

The driving unit 81 comprises a piezoelectric cylinder 1*a* piezoelectric actuator 67 and a piston member 66. The piezoelectric cylinder H1 is contained in housing member 54 so as to be arranged to an upper side of the spill chamber 111. The piezoelectric cylinder H1 contains the piezoelectric actuator 67 so as to be arranged to an upper side thereof. The piezoelectric actuator 67 operates to drive the hydraulic control valve 80. The piston member 66 is mounted on a bottom surface of the piezoelectric actuator 67 so as to support it. The piezoelectric cylinder H1 contains a cylinder member H2 which is formed with a large diameter cylinder H3 and a small diameter cylinder H4. The large diameter cylinder H3 is formed on an upper side of the spill chamber 111 so as to be coaxially arranged thereto and the small diameter cylinder H4 is formed on an upper side of the large diameter cylinder H3 so as to be coaxially arranged thereto. The vertical bores 502 and 503 inside of the cylinders H4 and H3 are communicated with the spill chamber 111.

The driving unit 81 comprises a small diameter piston 63 held in the vertical bore 502 to be slidable. The driving unit 81 comprises a large diameter piston 64 held in the vertical bore 503 to be slidable. A prong bottom end portion of the small diameter piston 63 projects through the drain port 109 into the valve chamber 108, thereby being permitted to contact to the valve member 62. Both of the pistons 63, 64 compart a space inside the vertical bores 502 and 503, and the comparted space is filled with fuel, thereby forming a hydraulic chamber 113.

The driving unit 81 also comprises a rod 75 disposed to an upper portion of the large diameter piston 64 so as to extend from a top surface thereof. The rod 75 is pressed to be fixedly fit into the piston member 66 so that the piston member 66 and the large diameter piston 64 are coupled through the rod 75.

The piston member 66 is adapted to separate spaces of a large diameter piston side and a piezoelectric side in the vertical bore 503.

The piston member 66 is formed at its outer periphery with an annular groove, and an O-ring 73 is disposed in the annular groove and arranged between an inner periphery of the piezoelectric cylinder H1 and the outer periphery of the piston member 66. The O-ring 73 seals a space between the inner periphery of the piezoelectric cylinder H1 and the outer periphery of the piston member 66 so as to keep the liquidtight therebetween.

The piezoelectric actuator 67 has a usual structure so that piezoelectric layers, such as PZT or the like, and electrode layers are alternately laminated in a movable direction of the piston member 66. Charging the piezoelectric actuator 67 from the actuator driving circuit 28 and discharging from the piezoelectric actuator 67 cause it to expand and contract The deformation of the piezoelectric actuator 67 is delivered to the piston member 66, and it is delivered through the large diameter piston 64 and hydraulic chamber 113 to the small diameter piston 63.

The piezoelectric cylinder H1 is formed at a lower side of the piston member 66 with a spring chamber 114 in which a spring 72 is arranged. The spring 72 urges the piston member 66 upwardly so as to keep the piston member 66 and the piezoelectric actuator 67 to be contacted to each other, and applies a constant load on the piezoelectric actuator 67.

The large diameter piston 64 integrally coupled to the piston member 66 is subjected to the urging force of the spring 72, causing the piston member 66 and the large diameter piston 64 to move integrally vertically according to the expansion and contraction of the piezoelectric actuator 67.

The spring chamber 114 is communicated with a substantially T-shaped passage 115 formed on the large diameter piston 64. The spring chamber 114 is also communicated with the drain passage 112, forming an accumulator chamber. A reverse valve 65 is provided in the T-shaped passage 115 and attached on a lower end surface of the large diameter piston 64. The reverse valve 65 is operative to replenish the fuel from the spring chamber 114 into the hydraulic chamber 113 when the fuel in the hydraulic chamber 113 due to leak of the fuel or the like.

That is, the reverse valve 65 is provided with a flat valve 651 for closing an opened bottom surface of the T-shaped passage 114. The flat valve 651 is formed with a pin hole 116 through which the T-shaped passage 114 can extend upwardly. The reverse valve 65 is also provided with a dished spring 652 which urges the flat valve 651 upwardly.

The housing member 54 is also formed with a passage 117 communicating between the spring chamber 114 and the drain passage 112, and provided with a blank plug 56 with which the passage 117 is filled.

The cylinder member H2 is formed with a small diameter passage (pin hole) at an upper side of the small diameter piston 63 which is served as a stopper, which is the pin hole 116, for controlling the upper movement of the small diameter piston 63. The large cylinder H3 and the small cylinder H4 are communicated with each other through the small diameter passage. A hydraulic chamber 85 arranged between the small diameter passage and the small diameter piston 63 and the hydraulic chamber 113 arranged between the hydraulic chamber 85 and the large diameter chamber 64 form a displacement expansion chamber 86. The displacement expansion chamber 86 converts the displacement of the piezoelectric actuator 67 into hydraulics, thereby amplifying the hydraulics, for example, by from two to three times the displacement of the large diameter piston 64, due to the ratio of the cross-sectional area of large diameter piston 64 to that of small diameter piston 63. The amplified hydraulics is delivered to the small diameter piston 63.

The bottom portion of the small diameter piston 63 is positioned in the spill chamber 111 arranged to a lower side of the cylinder member H2. A tip end of the bottom portion has a small diameter than its remained portion and is inserted in the drain port 109, thereby contacting to the valve member 62.

The flat valve 651 and the dished spring 652 are contained to be held in a holder 87 which has a bottomed tubular shape and is pressed to be fit in an outer periphery of the bottom portion of the large diameter piston 64. A bottom surface of the holder 87 is formed with a penetration hole 88 penetrated therethrough, and the fuel freely flows between an inner space of the holder 87 and the displacement expansion chamber 86.

The pin hole (stopper) 116 permits the fuel in the displacement expansion chamber 86 to be leaked into the spring chamber 114 even if trouble in the actuator driving circuit 28 occurs during fuel injection, causing the fuel injection to be interrupted. In addition, after assembling the injector 1, the pin hole 116 permits the displacement expansion chamber 86 to be easily evacuated, thereby filling the fuel in the evacuated displacement expansion chamber 86. No air, therefore, is remained in the displacement expansion chamber 86 so that no malfunction occurs in the injector 1.

Operations of the above configured fuel injection system with the injector 1 is explained hereinafter.

When making the valve member 61 fully open so as to locate it at a full lift position, the actuator driving circuit 28 supplies voltage sufficient to open the drain port 109 and close the high pressure port 110, the piezoelectric actuator 67 is charged by the supplied voltage to expand according thereto. The extension of the piezoelectric actuator 67 makes move downwardly the piston member 66 and the large diameter piston 64 by a same amount of displacement, causing the hydraulics in the displacement expansion chamber 86 to be increased. The increase of the hydraulics in the displacement expansion chamber 86 makes displace downwardly the small diameter piston 63. The displacement amount of the small diameter piston 63 depends on the ratio of the cross-sectional area of large diameter piston 64 to that of small diameter piston 63.

The downward displacement of the small diameter piston 63 presses the valve member 62 downwardly so as to move it downwardly from the drain seat 108*a* so that the valve member 62 is seated on the high pressure seat 108*b*, that is, the valve member 62 is located at a full lift position.

The downward movement of the valve member 62 makes open the drain port 109, and close the high pressure port 110, thus decreasing the pressure in the valve chamber 108.

In cases where the hydraulic pressure in the duel accumulator 102 to which the needle 61 is subjected upwardly exceeds the hydraulic pressure in the back pressure chamber 105 and the spring force of the spring 71, the needle 61 is lifted from the nozzle seat 103*a*, thus starting the injection of fuel.

On the other hand, when making the valve member 61 fully close so as to locate it at a full close position, the actuator driving circuit 28 makes the piezoelectric actuator 67 discharge so that, while the piezoelectric actuator 67 is discharged, the piezoelectric actuator contracts by its expanded displacement during the supply of the voltage so as to be returned to its original length, thereby moving upwardly the piston member 66 by the urging force of the spring 72. The large diameter piston 64 coupled to the piston member 66 through the rod 75 moves upwardly with the piston member 66, causing the hydraulics in the displacement expansion chamber 86 to be decreased. The decrease of the hydraulics in the displacement expansion chamber 86 causes the small diameter piston 63 not to be subjected to force, which is caused by the increase of the hydraulic pressure in the displacement expansion chamber 86 and permits the valve member 62 to be pressed to the high pressure seat 108*b* against the high pressure in the high pressure port 110, whereby the small diameter piston 63 moves upwardly with the valve member 62.

As a result, the valve member 62 is seated on the drain seat 108*a* again so that the valve member 62 returns to an original position (full close position). The return of the valve member 62 to the original position makes open the high pressure port 110 and close the drain port 109, thus recovering (increasing) the pressure in the valve chamber 108 and the back pressure chamber 105.

In cases where the increased pressure in the back pressure chamber 105 and the spring force of the spring 71 to which the needle 61 is subjected downwardly exceeds the hydraulic pressure in the duel accumulator 102, the needle 61 moves downwardly so as to be seated again on the nozzle seat 103*a*, thus interrupting the injection of fuel.

The actuator driving circuit 28 includes, for example, a DC—DC converter which can operate on the basis of a battery (not shown) as a power source. The actuator driving circuit 28 changes the piezoelectric actuator 67 between a state that it is charged and that it is discharged according to a control signal transmitted from the ECU 27. The control signal is, for example, a binarized signal consisting of high level and low level so that the actuator driving circuit 28 carries out the charge of the piezoelectric actuator 67 in response to the rising of the control signal from the low level to the high level, and carries out the discharge thereof in response to the falling of the control signal from the high level to the low level. The charge of the piezoelectric actuator 67 is performed with the voltage between both end portions thereof monitored. The voltage between both end portions of the piezoelectric actuator 67 may be referred to as piezo-actuator voltage, hereinafter. When the monitored piezo-actuator voltage equals to a target voltage, the charge of the actuator 67 is completed. The target voltage can be changeable according to a target voltage signal inputted from the ECU 27. The target voltage signal is received by the actuator driving circuit 28 as a signal which is proportioned to, for example, the target voltage. The actuator driving circuit 28 recognizes the completion of the charge according to a binarized output signal outputted from a conparator which compares the value of the target voltage signal from the value of the monitored voltage.

The ECU 27 is configured to usually include a computer and so on. That is, the ECU 27 comprises a CPU 271, a RAM (Random Access Memory) which is served as a working area of the CPU 271, a ROM (Read Only Memory) as a nonvolatile memory, on which a control program that the CPU 271 can execute is stored.

In accordance with the control program of the first embodiment, the CPU 271 of the ECU 27 can execute the control program so as to calculate the injection timings and the injection quantity of fuel for each injection according to detection signals including, for example, a crank angle and so on, thereby outputting the control signal at each of the injection timings. The CPU 271 also can set the target voltage, as a condition of energization of the piezoelectric actuator 67, so as to output target voltage signal corresponding to the set target voltage.

Next, when keeping the valve member 61 at a half lift position between the full lift position and the full close position, operations of the above configured injector 1 is explained hereinafter.

That is, in this embodiment, the injector 1 is configured so that the energy E required for opening the drain port 109 by the piezoelectric actuator 67 is smaller than the energy E' required for closing the high pressure port 110 thereby.

In addition, the actuator driving circuit 28 sets the voltage energy supplied to the actuator 67 to the energy which is not less than the energy E required for opening the drain port 109 by the piezoelectric actuator 67, and is not more than the energy E required for closing the high pressure port 110 thereby, so that, because the high pressure port is not closed, the hydraulic pressure in the high pressure port 110 permits the valve member 62 which is lifted from the drain seat 108*a* not to be seated on the high pressure seat 108*b* while the needle 61 is seated on the nozzle seat 103*a*.

Figure 4:
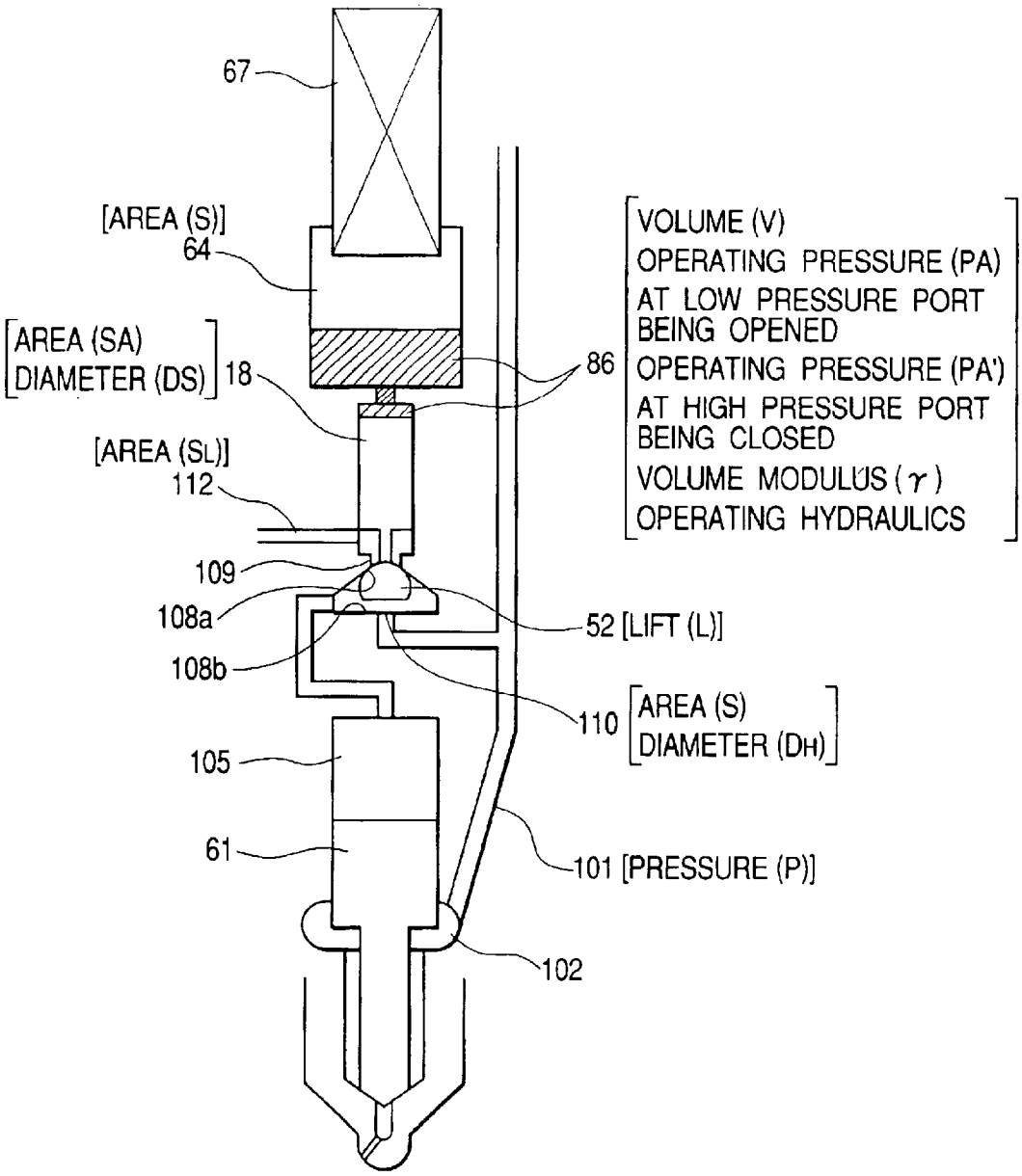
FIG. 4 is a view showing the injector capable of controlling a valve member to keep it at a half lift position according to the first embodiment.

FIG. 4 shows the injector 1 capable of controlling the valve member 62 to keep it at a half lift position according to the first embodiment.

In FIG. 4, as main elements of the injector 1 required for delivering the displacement of the piezoelectric actuator 67 to the valve member 62, the large diameter piston 64, the displacement expansion chamber 86, the small diameter piston 63 and so on are illustrated.

Then, a seat area of the drain port 109, which is opened and closed 2 by the valve member 62, is expressed as $S_L$ ($mm^2$), a seat area of the high pressure port 110, which is opened and closed by the valve member 62 is expressed as $S_H$ ($mm^2$) and a diameter of the high pressure port 110 is expressed as $d_H$ (mm).

In addition, a volume of the displacement expansion chamber 86 is expressed as V ($mm^3$), an operating pressure of the displacement expansion chamber 86 while the drain port 109 is opened is expressed as PA ($Kg/mm^2$), an operating pressure of the displacement expansion chamber 86 while the high pressure port 110 is closed is expressed as PA' ($Kg/mm^2$) and a volume modulus of the operating hydraulics in the displacement expansion chamber 86 is expressed as γ ($Kg/mm^2$).

Furthermore, an area of the small diameter piston 63, on which the hydraulic pressure is received is expressed as SA ($mm^2$), a diameter of which is expressed as d (mm) and an area of the large diameter piston 64, on which the hydraulic pressure is received is expressed as S ($mm^2$).

Still further more, an amount of the lift movement of the valve member 62 from the drain seat 108*a* to the high pressure seat 108*b* is expressed as L (mm), a pressure in the high pressure passage 3, which equals to a pressure in the common-rail 24, is expressed as P ($Kg/mm^2$), a displacement amount of the piezoelectric actuator 67 required for opening the drain port 109 is expressed as δ and a displacement amount of the piezoelectric actuator 67 required for closing the high pressure port 110 is closed is expressed as δ'.

Then, force F required for opening the drain port 109 is expressed as the following equation (1):

$$F=S_L\cdot P=SA\cdot PA=SA\cdot\gamma\cdot(S\cdot\delta/V) \tag{1}$$

Under such condition, the energy E required for the piezoelectric actuator 67 is expressed as the following equation (2):

$$\begin{aligned} E &= 1/2\cdot\delta\cdot p \\ &= 1/2\cdot(V\cdot S_L\cdot P/SA\cdot\gamma\cdot S)\cdot S\cdot(S_L\cdot P/SA) \\ &= 1/2\cdot(S_L\cdot P/SA)^2\cdot V/\gamma \end{aligned} \tag{2}$$

On the other hand, force F' required for closing the high pressure port 110 is expressed as the following equation (3):

$$F'=S_H\cdot P=SA\cdot PA'=SA\cdot\gamma\cdot(S\cdot\delta'/V) \tag{3}$$

Under such condition, the energy E' required for the piezoelectric actuator 67 is expressed as the following equation (4):

$$\begin{aligned} E' &= PA'\cdot SA\cdot L+1/2\cdot\delta'\cdot S\cdot p' \\ &= 1/2\cdot(V\cdot S_L\cdot P/SA\cdot\gamma\cdot S)\cdot S\cdot(S_L\cdot P/SA) \\ &= S_H\cdot P\cdot L+1/2\cdot(S_H\cdot P/SA)^2\cdot V/\gamma \end{aligned} \tag{4}$$

where, in the equation (4), the $S_H\cdot P\cdot L$ represents the workload caused by the valve member 62, and the $\frac{1}{2}\cdot(S_H\cdot P/s)^2\cdot V/\gamma$ represents the workload of the increase of the hydraulic pressure.

A relationship among these parameters of $S_L$, $S_H$, V, SA and L required for satisfying the equation of E'>E is expressed as the following equation (5):

$$S_H\cdot P\cdot L+1/2\ (S_H\cdot P/SA)^2\cdot V/\gamma>1/2\cdot(S_L\cdot P/SA)^2\cdot V/\gamma \tag{5}$$

Therefore, setting these parameters of $S_L$, $S_H$, V, SA and L so as to hold the equation (5) causes the energy E' required for opening the drain port 109 to be greater than the energy E required for closing the high pressure port 110, making it possible to easily perform the half lift control of keeping the valve member 62 at a half lift position between the drain seat 108*a* of the drain port 109 and the high pressure seat 108*b* of the high pressure port 110.

A concrete example of the injector 1 is shown hereinafter.

For example, in cases of setting the diameter $d_H$ of the high pressure port 110 to approximately 0.5 mm, setting the pressure P in the common-rail 24 to approximately 20 ($Kg/mm^2$), that is, approximately 2000 ($Kg/cm^2$), setting the amount L of the lift movement of the valve member 62 to approximately 0.03 (mm), setting the diameter $d_S$ of the small diameter piston 63 to approximately 5 (mm), setting the volume V of the displacement expansion chamber 86 to approximately 5 ($mm^3$) and setting the volume modulus γ of the operating hydraulics in the displacement expansion chamber 86 to approximately 100 ($Kg/mm^2$), a seat diameter $d_L$ of the drain seat 108*a* is determined.

In addition, the seat area $S_H$ of the high pressure port 110 and the area s of the small diameter piston 63 are calculated on the basis of the following equations (6) and (7):

$$S_H=\pi/4\cdot d_H^2=\pi\times(0.5)^2/4=0.196\ (mm^2) \tag{6}$$

$$s=\pi/4\cdot d_S=\pi\times(5)^2/4=19.6\ (mm^2) \tag{7}$$

Then, substituting these values of $S_H$, V, P, SA, L and γ into the equation (5), the equation (5) is represented as the equation (8):

$$\{0.196\times20\times0.03+1/2\times(0.196\times20/19.6)^2\times100/5\}>\{1/2\times(S_L\times20/19.6)^2\times100/5\} \tag{8}$$

This equation can represent the seat area $S_L$ of the drain port 109 and the diameter $d_L$ of the drain seat 108*a* as the following equations (9)~(11):

$$0.18\times0.001>0.026\times S_L^2>0.026\times S_L^2 \quad (9)$$

$$S_L<\sqrt{(0.119/0.026)}=2.14\ (\mathrm{mm}^2) \quad (10)$$

$$d_L<\sqrt{(4\times2.14/\pi)}=1.65\ (\mathrm{mm}) \quad (11)$$

As described above, when the injector 1 is designed so that the diameter $d_H$ is set to approximately 0.5 mm, the pressure P is set to approximately 20 (Kg/mm$^2$), the amount L is set to approximately 0.03 (mm), the diameter $d_S$ is set to approximately 5 (mm), the volume V is set to approximately 5 (mm$^3$) and the volume modulus γ is set to approximately 100 (Kg/mm$^2$), set of the diameter $d_H$ of the drain seat 108*a* to a diameter less than 1.65 (mm) can hold the equation (5).

The actuator driving circuit 28, therefore, sets the voltage energy supplied to the actuator 67 to the energy which is not less than the energy E required for opening the drain port 109 by the piezoelectric actuator 67, and is not more than the energy E' required for closing the high pressure port 11, thus preventing the high pressure port 110 from being closed, making it possible to securely keep the valve member 62 at a half lift position between the drain seat 108*a* and the high pressure seat 108*b*. This allows the pressure in the back pressure chamber 105 to be easily controlled, making it possible to accurately inject a small amount of fuel and to improve the performance of the injector 1.

In addition, the keep of the valve member 62 securely at a half lift position between the drain seat 108*a* and the high pressure seat 108*b* permits the fuel in the common-rail 24 to be relieved into the drain passage 112, making it possible to easily control the pressure in the back pressure chamber 105 while keeping the needle 61 to the closed state.

As a result, the configuration of the injector 1 permits the half lift control of the valve member 62 without additionally providing any special depressurization valve, thereby making compact the size of the injector 1 and increasing the performance thereof.

Second Embodiment

In this second embodiment, the configurations of the fuel injection system and the injector 1A are substantially the same as those of the fuel injection system and the injector 1 of the first embodiment, and therefore, the elements of the fuel injection system and the injector 1A of the second embodiment, which are the same as those of the fuel injection system and the injector 1 of the first embodiment, are given the same characters in FIGS. 1~3.

According to the second embodiment, on the ROM 273A, reference voltages V0 of corresponding injectors 1A, reference actuator temperatures T0 thereof, a reference common-rail pressure P0 and a reference lift amount L0 are previously stored as data in addition to the program.

Furthermore, according to the second embodiment, the CPU 271A of the ECU 27A executes a control program, which is different from that of the first embodiment, so as to control the piezoelectric actuator 67.

Figure 5:
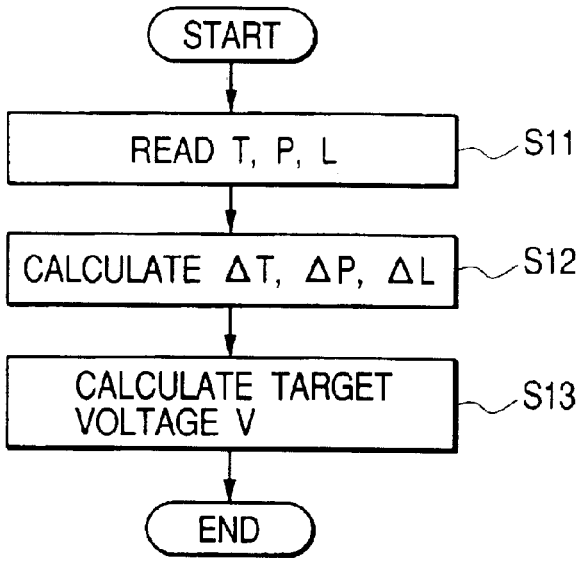
FIG. 5 is a flow chart showing control procedures executed by an ECU of a fuel injection system according to a second embodiment of the present invention.

FIG. 5 shows control procedures executed by the CPU 271A of the ECU 27A. First, the CPU 271A reads an actuator temperature T, a common-rail pressure P and a lift amount L (Step S11).

The actuator temperature T is a temperature of the piezoelectric actuator 67, and, in this embodiment, a temperature sensor may be directly disposed to the piezoelectric actuator 67 so that the CPU 271A reads the actuator temperature T from the temperature sensor. In addition, a temperature sensor may be mounted on the surface of the injector 1A so that the CPU 271A may convert the detected temperature of the temperature sensor to the actuator temperature T of the actuator 67.

In addition, the actuator temperature T may be obtained by the temperature of cooling water, or be estimated by the operating state of the actuator 67.

Furthermore, the capacitance of the piezoelectric actuator 67 depends on the actuator temperature T so that the actuator temperature T may be obtained according to the capacitance of the actuator 67 calculated by resonant characteristic of the actuator 67 subjected to weak volts alternating current.

The CPU 271A reads a detected pressure as the common-rail pressure P by a pressure sensor 29.

The lift amount L is a displacement amount of the large diameter piston 64. The L is a reference lift amount L0 while usually injecting fuel.

In a case of depressurizing the common-rail pressure in the common-rail 24, for example, in a case of cutting fuel in decelerating operation, or performing the depressurization operation of the common-rail pressure in intervals of injection controls because the actual common-rail pressure is higher than the target pressure, the lift amount L is nL0 which is obtained by multiplying the reference lift amount L by a coefficient n so that the lift amount L (nL0) is smaller than the reference lift amount L0.

The CPU 271A subtracts the corresponding reference values T0, P0 and, L0, which are read from the ROM 273, from the detected actuator temperature T, the detected common-rail pressure P and the detected lift amount L so as to calculate variations ΔT, ΔP and ΔL from the corresponding reference values T0, P0 and L0 (Step S12). Then, the reference actuator temperature T0, the reference common-rail pressure P0 and the reference lift amount L0 are previously stored on the ROM 273 together.

The CPU 271A calculates the target voltage V on the basis of the equation (12) (Step S13):

$$V = V0\sqrt{\frac{(1+\beta\Delta P)(1+\gamma L)}{1+\alpha}} \quad (12)$$

where V0 is a reference voltage, and α,β and γ are constant values.

The CPU 271A outputs a target voltage signal proportional to the target voltage V to the actuator driving circuit 28.

Incidentally, the reference voltage V0 and the constant values α, β and γ are also previously stored on the ROM 273. The reference voltage V0, described hereinafter, is a charging voltage required in cases where the actuator temperature T, the common-rail pressure P and the lift amount L becomes the reference values T0, P0 and L0. The charging voltage V0 of each piezoelectric actuator 67 is individually measured. Each reference voltage V0 and each reference actuator temperature T0 read by the CPU 271A correspond to each injector 1A (injection cylinder) of the fuel injection system. Incidentally, the reference values P0 and L0 are common to all injectors 1A.

Then, measurement procedures of measuring the reference voltage V0 and the reference actuator temperature T0 are explained. When the assemble of each injector 1A is completed by the injector manufacturer, each injector 1A is set to an injection tester so as to make drive each injector 1A under the reference common-rail pressure P0, causing each injector to perform the next predetermined operation. When each injector 1A performs the predetermined operation, the reached charging voltage V0 of each injector is measured. This measurement process is performed in a final process in the injector manufacturer.

Then, usually, the greater is the charging voltage, the greater is the lift amount of the valve member 62, but, in the measurement process, the state of the predetermined operation is the state such that the valve member is fully lifted. The reference voltage V0 is determined on the basis of the following procedures.

That is, the fuel injections are repeated so that the injection amount of each fuel injection is measured. On condition that the average of the injection amounts is in the range of design tolerance of each injector, the minimum of the charging values that permit the variations of the injection amount not to be more than a predetermined stable limit value is determined as the reference voltage V0.

While the charging voltage is reached to the voltage V0, the charging current to the piezoelectric actuator 67 is measured to be integrated, thereby obtaining the charge supplied to the piezoelectric actuator 67. The charging voltage V0 divides the obtained charge to obtain the reference actuator temperature T0. This means to directly calculate the capacitance of the piezoelectric actuator 67, but because the capacitance is increased in proportion to the actuator temperature, the capacitance of the piezoelectric actuator 67 is the indicator of the actuator temperature.

The lift amount L which equals to nL0 corresponds to the half lift of the valve member 62, and the target voltage at the lift amount L being nL0 is set so as to give a voltage which permits the injection amount of the injector to be made zero and drain amount from the back pressure chamber 105 of the injector 1A to be maximized. A ratio of this voltage (target voltage) to the charging voltage (reference voltage V0) corresponding to the full lift of the valve member 62 is a constant so that the coefficient n determining the lift amount of the valve member 62 which moves to a half lift position is nearly varied among each of the injectors 1A. The common lift amount L (=nL0) among each injector 1A is stored on the ROM 273 of the ECU 27.

Incidentally, writing procedures of writing the measured reference voltage V0 and the reference actuator temperature T0 onto the ROM 273 are described hereinafter. Moreover, the $\alpha$, $\beta$ and $\gamma$ are coefficients for calculating the target voltage according to the variations $\Delta T$, $\Delta P$ and $\Delta L$.

The ECU 27A sets the target voltage V of the actuator 67 in accordance with the equation (12) based on the reference voltage V0 and the reference actuator temperature T0, obtaining the next effects.

On the Influence of Actuator Temperature

Figure 7:
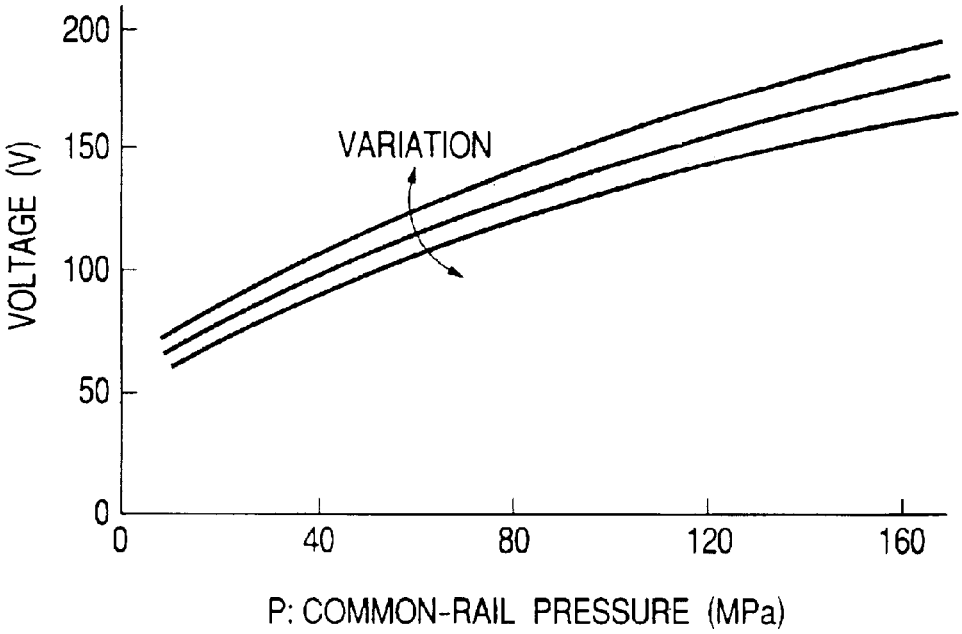
FIG. 7 is a graph for explaining effects related to the second embodiment of the present invention.

The expansion amount of the piezoelectric actuator 67 is determined by the energy kept therein. The completion of charging the piezoelectric actuator 67 is determined whether or not the voltage of the piezoelectric actuator 67 is reached to the target voltage V. FIG. 7 is a graph showing charging voltages for supplying required energies E0 to the plurality of injectors according to the actuator temperature T.

As shown in FIG. 7, it is noted that the charging voltages for supplying the required energies E0 to the plurality of injectors each of which has the same specification vary according to their actuator temperatures T. This is because the kept energies in the actuators 67 are different from each other due to differences of their capacitances C.

Then, assuming that the energy required for making the valve member the predetermined operating state (full lift) is E0, when the actuator temperature T varies from the reference temperature T0 by $\Delta T$, the capacitance C can be represented as C0 $(1+\alpha\Delta T)$ so that, in cases where the only actuator temperature T varies from a reference operating condition, the charging voltage V required for the energy E0 to the actuator 67 is represented as the equation (13):

$$V = \sqrt{\frac{2E0}{C0(1+\alpha\Delta T)}} = V0\sqrt{\frac{1}{1+\alpha T}} \tag{13}$$

Therefore, setting the target voltage V of charging voltage according to the equation (12) permits the energy to be properly supplied to the piezoelectric actuator 67 even if the actuator temperature T varies because the target voltage V smoothly follows the variation of the actual actuator temperature T.

Figure 6:
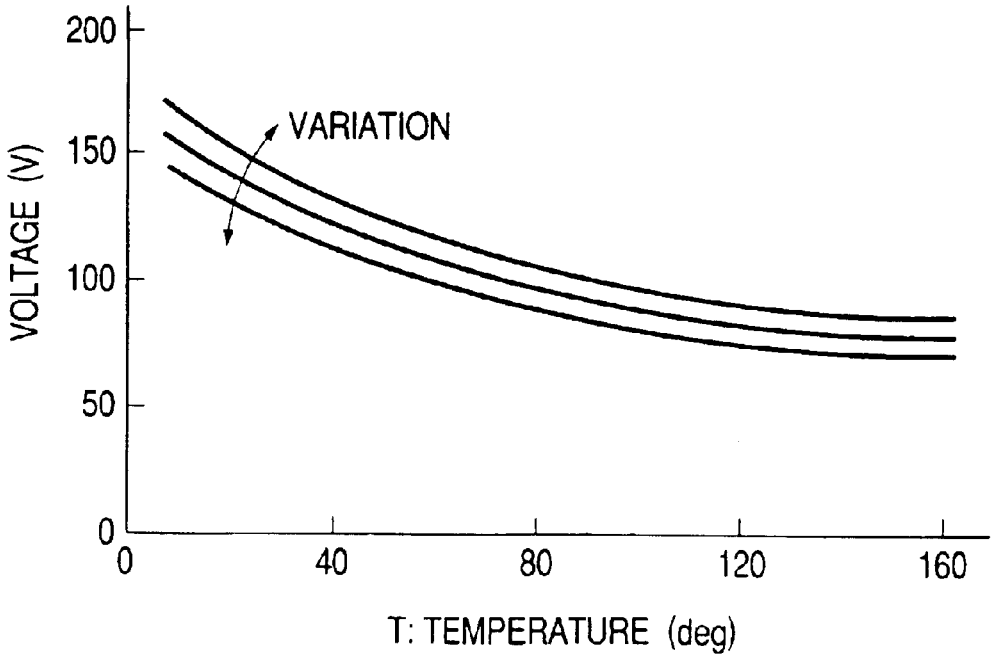
FIG. 6 is a graph for explaining effects related to the second embodiment of the present invention.

In addition, as noted by FIG. 6, the charging voltage to which the required energy E0 is supplied vary dependently on the individual differences between the injectors, but, the reference voltages V0 of the respective injectors are measured, thereby absorbing the individual differences of injectors. In addition, it is possible to absorb the variations of the capacitances of the actuators 67.

On the Influence of Common-Rail Pressure

The greater is the common-rail pressure P, the greater the urging force upwardly applied to the valve member 62, that is, the greater is the load of the extension of the piezoelectric actuator 67, the greater proportionally is the required energy E0. FIG. 7 is a graph showing a relationship between the lift amounts of the plurality of injectors each of which has the same specification and the charging voltages thereof.

The energy E is represented as "E0 $(1+\beta\Delta L)$", where the $\beta$ indicates the coefficient of the lift amount of the energy so that, when only the common-rail pressure deviates from the corresponding reference operating condition, the required charging voltage is represented as the equation (14):

$$V = \sqrt{\frac{2E0(1+\beta\Delta P)}{C0}} = V0\sqrt{1+\beta\Delta P} \tag{14}$$

Therefore, setting the target voltage V of charging voltage according to the equation (12) permits the energy to be properly supplied to the piezoelectric actuator 67 even if the common-rail pressure P varies because the target voltage V smoothly follows the variation of the actual common-rail pressure P.

In addition, as noted by FIG. 7, the charging voltage to which the required energy E0 is supplied vary dependently on the individual differences between the injectors, but, the reference voltages V0 of the respective injectors are measured, thereby absorbing the individual differences of injectors. In addition, it is possible to absorb the variations of the capacitances of the actuators 67.

On the Influence of Lift Amount

Figure 8:
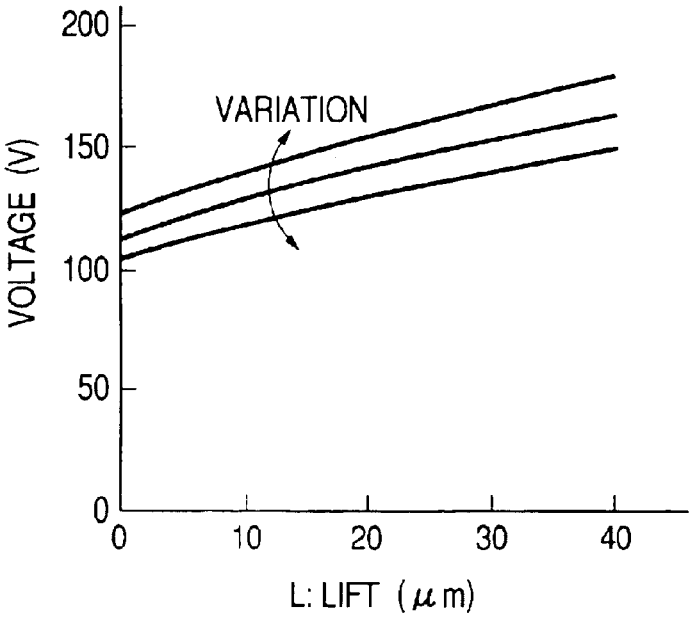
FIG. 8 is a graph for explaining effects related to the second embodiment of the present invention.

The greater is the required lift amount of the large diameter piston 64, that is, the greater is the extension amount of the piezoelectric actuator 67, the greater proportionally is the required energy E0. FIG. 8 is a graph showing a relationship between the lift amounts of the plurality of injectors each of which has the same specification and the charging voltages thereof.

The energy E is represented as "E0 (1+γΔL)", where the γ indicates the coefficient of the lift amount of the energy so that, when only the lift amount deviates from the corresponding reference operating condition, the required charging voltage is represented as the equation (15):

$$V = \sqrt{\frac{2E0(1+\gamma\Delta L)}{C0}} = V0\sqrt{1+\gamma\Delta L} \quad (15)$$

Therefore, setting the target voltage V of charging voltage according to the equation (12) permits the energy to be properly supplied to the piezoelectric actuator 67 even if the lift amount L varies with the depressurization control performed, because the target voltage V smoothly follows the variation of the actual lift amount L.

In addition, as noted by FIG. 8, the charging voltage to which the required energy E0 is supplied vary dependently on the individual differences between the injectors, but, the reference voltages V0 of the respective injectors are measured, thereby absorbing the individual differences of injectors.

Incidentally, the ratio of the lift amount L to the reference L0 in the equation (15) makes sense so that it is not necessary to use the actual lift amount. For example, the L0 can be taken as 1 so as to calculate the equation (12). The valve member 62 can move only between the full lift position corresponding to the usual fuel injection control and a half lift position corresponding to the depressurization control of the common-rail pressure so that two coefficients corresponding to the full lift position and the half-lift position, by which the reference voltage is multiplied, may be stored on the ROM 273.

It is possible to make the injector 1A the predetermined operating state without depending on the individual differences of injectors 1 and the variations of the operating conditions, thereby easily controlling the lift amount of the valve member 62. Furthermore, it is possible to prevent the injection characteristic from varying over time.

The actuator temperature T does not rapidly vary so that taking the actuator temperature may be performed every predetermined spans, which are longer than those of the common-rail pressure or the like.

The reference voltage V0 is obtained by measuring it with the valve member 62 made to the full lift position at which the fuel injection can be performed, whereas the reference voltage V0 may be obtained by measuring it with the valve member 62 made to a half lift position in the predetermined operating state. That is, when changing the charging voltage of the piezoelectric actuator 67 under a given condition, the drain amount of fuel from the injector 1A is measured. At that time, the voltage at which the drain amount is maximized is taken as V0. In this case, the ratio of the charging voltage corresponding to the half lift to that corresponding to full lift is constant with no influence of the individual differences of injectors 1A so that the target voltage V0 for the cases of moving the valve member 62 at a half lift position, for example, when cutting fuel for deceleration, is calculated by regarding the lift amount L as the predetermined reference lift amount, such as 1. The target voltage V when performing usual injection control, that is, controlling the valve member 62 to locate it to the full lift position, is calculated according to the ratio of the lift amount of the valve member 62 in cases of being moved to the full lift position to the reference lift amount.

The reference voltage may be determined on the basis of the charging voltage required for making the valve member 62 an another state which is different from the full lift state and the half lift state. For example, the reference voltage may be determined as a maximum voltage in cases where the injection amount becomes 0 and the drain amount from the injector 1A becomes a minimum value in a state that only fuel from each part of the injector 1A naturally leaks, maximum voltage which is a voltage in a state (a predetermined operating state) that the drain amount is of minimum and the lift amount of the valve member 62 is of maximum. In these cases, each target voltage V of each of the full lift state and the half lift state is set according to the ratio of the lift amount of the valve member 62 to that of the valve member 62 which operates under the predetermined operating condition.

Next, the procedures for writing the reference voltage V0 and the reference actuator temperature T0 are described hereinafter.

The QR code pattern 16 is formed on the top surface of the connector portion 15. The QR code pattern 16 includes individual data, such as the reference voltages V0 and the reference actuator temperatures T0, of the respective injectors 1A. The marking of the QR code pattern 16 is formed by, for example, a laser in a manufacturing procedure or the like, after the reference voltages V0 and the reference actuator temperatures T0 are measured.

Figure 9:
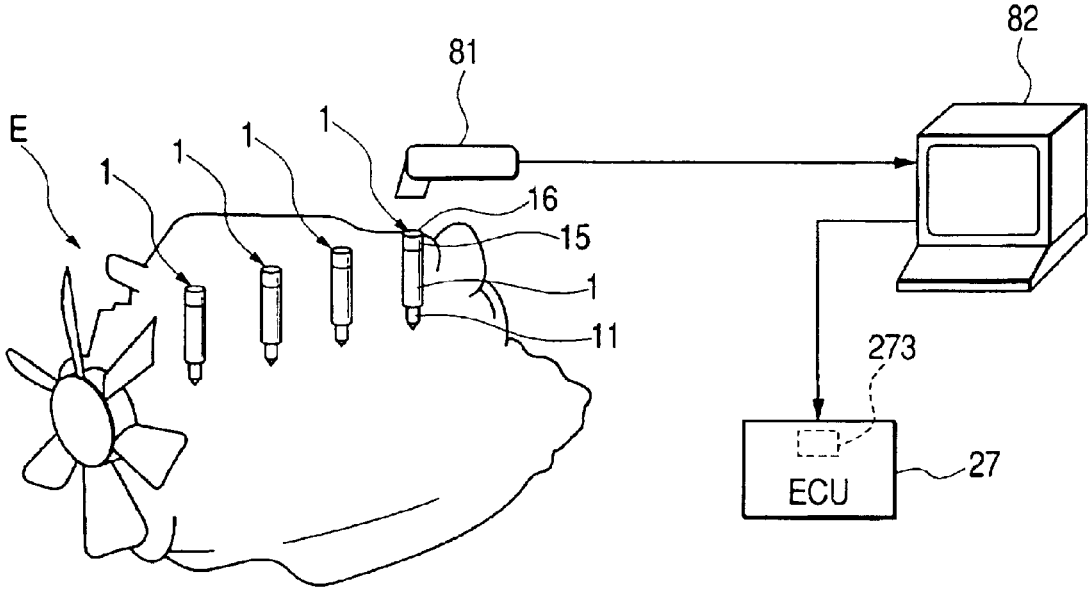
FIG. 9 is a view for explaining a adjusting method according the second embodiment of the present invention.

Reading the QR code pattern 16 is performed in a state that the assembling of the engine is completed so that the engine is permitted to be transferred to final procedure of inspection. FIG. 9 shows the reading procedures. In FIG. 9, portions of the injector 1A except for the engine 1 are substantially omitted. At first, the optical scanner reads the QR code pattern 16 formed on the top surface of the connector portion 15 so as to convert the read QR code pattern 16 into code signals, thereby transmitting the code signals to a data transfer system 82. The data transfer system 82 comprises a computer, a ROM writer, a storage medium, a CRT (Cathode-Ray Tube) and so on, and, for example, displays a number of the cylinder corresponding to at least one of the injectors 1 so as to indicate the at least one of the injectors 1A to an operator, at least one of the injectors 1A of which the operator should read the QR code pattern 16. The QR code patterns 16 of all cylinders are temporally stored on the storage medium. Next, the reference voltage V0 of each injector 1 corresponding to the information of each QR code pattern. 16 is written on the ROM 273 of the ECU 27A with the ROM writer so that, as the ROM 273, a nonvolatile memory, such as, an EEPROM (Electrically-Erasable Programmable Read Only Memory), a flash memory or the like is used.

In the engine E with the configuration shown in FIG. 2, the valve drive units 44, 45, the cam shafts 46, 47 and the injector are mounted on the cylinder head 32. The connector portion 15 on which the QR code pattern 16 is formed is exposed even if the head cover 33 is covered on the top portion of the cylinder head 32 so that the QR code pattern 16 can be read with the workability being excellent in a state that the assembling of the engine E is completed so that the engine E is permitted to be transferred to final procedure of inspection. In addition, when the vehicle on which the engine E is installed is able to actually drive, the QR code pattern 16 can also be read again without taking the engine E apart, improving the maintenance characteristic of the engine E.

Incidentally, the code pattern is not limited to the QR code pattern. Another two-dimensional code, one-dimensional code, such as barcode or other kinds of symbols may be used as the code pattern.

The code pattern is not limited to the structure of directly marking (printing) it on the surface of the injector 1A by the laser. That is, a tag on which the code pattern is printed may be pasted.

As an information storage medium including information corresponding to the reference voltage and so on, a resistor in place of the code pattern may be provided. In this structure, the ECU may measure a resistance of the resistor so as to detect the reference voltage and so on according to the measured resistance. In addition, as an information storage medium, an IC chip may be used.

Moreover, a method for transferring the data including the reference voltage V0, the reference actuator temperature T0 and so on to the ROM 273 can be randomly selected. For example, in cases where the ECU 27A to which the injector 1A is assembled can be determined, the data including the reference voltage V0, the reference actuator temperature T0 and so on, which are previously stored on a database, may be written on the ROM 273 therefrom.

It is natural that collection values including an output timing and an output time of the control signal may be held on the code pattern, correction values which permit the individual differences of the injectors 1A about their injection characteristics to be canceled.

In this embodiment, the target voltage V is set on the basis of the operating conditions including the actuator temperature T, the common-rail pressure P and the lift amount L in addition to the reference voltage V0, whereas the target voltage V may be set according to at least one of the actuator temperature T, the common-rail pressure P and the lift amount L or at least two thereof in accordance with the required specification of the injection system.

The operating conditions may be determined according to other parameters.

In cases of permitting the actuator temperature T to be constant when measuring the charging voltage required for making the injector 1A a predetermined operating state, the individual information of the injector 1A to be coded is only the reference voltage so that the reference actuator T0 may be uniformly stored on the ECU 27A together with the reference common-rail pressure P0 and the reference lift amount L0.

In this embodiment, converting the single reference voltage V0 into the data under the actually operating conditions according to the gaps ($\Delta T$, $\Delta P$ and $\Delta L$) makes set finally the target voltage V, whereas the target voltage can be set with another manner.

That is, in another manner, the charging voltage which permits the injector 1A to become the predetermined operating condition is measured so as to be written on the ROM so that an internal interpolation may make the target voltage correspond to the actual operating conditions.

This embodiment is applied to the configuration of the actuator, which makes move the valve member 62 between the full lift position and the half lift position so as to control the lift amount, but the present invention may be applied to the fuel injection system which performs only the control of the piezoelectric actuator 67 so as to change the state of fuel injection and that of interrupting the fuel injection.

In place of the target voltage being changeable according to the operating conditions, the reference voltage data read from the QR code pattern of the injector 1A may be set as the target voltage in accordance with the required specification of the injection system. This configuration prevents the variations of the lift amounts of the valve members 62 due to the individual differences of the injectors 1A, the loss of the energy and the variation of the injection characteristic over time due to wear.

In this case, the reference voltage is taken as the data measured under the predetermined reference operating conditions, causing the operations of the actuators to be synchronized with each other without storing on the ROM the operating conditions at measuring the reference voltage.

Figure 10:
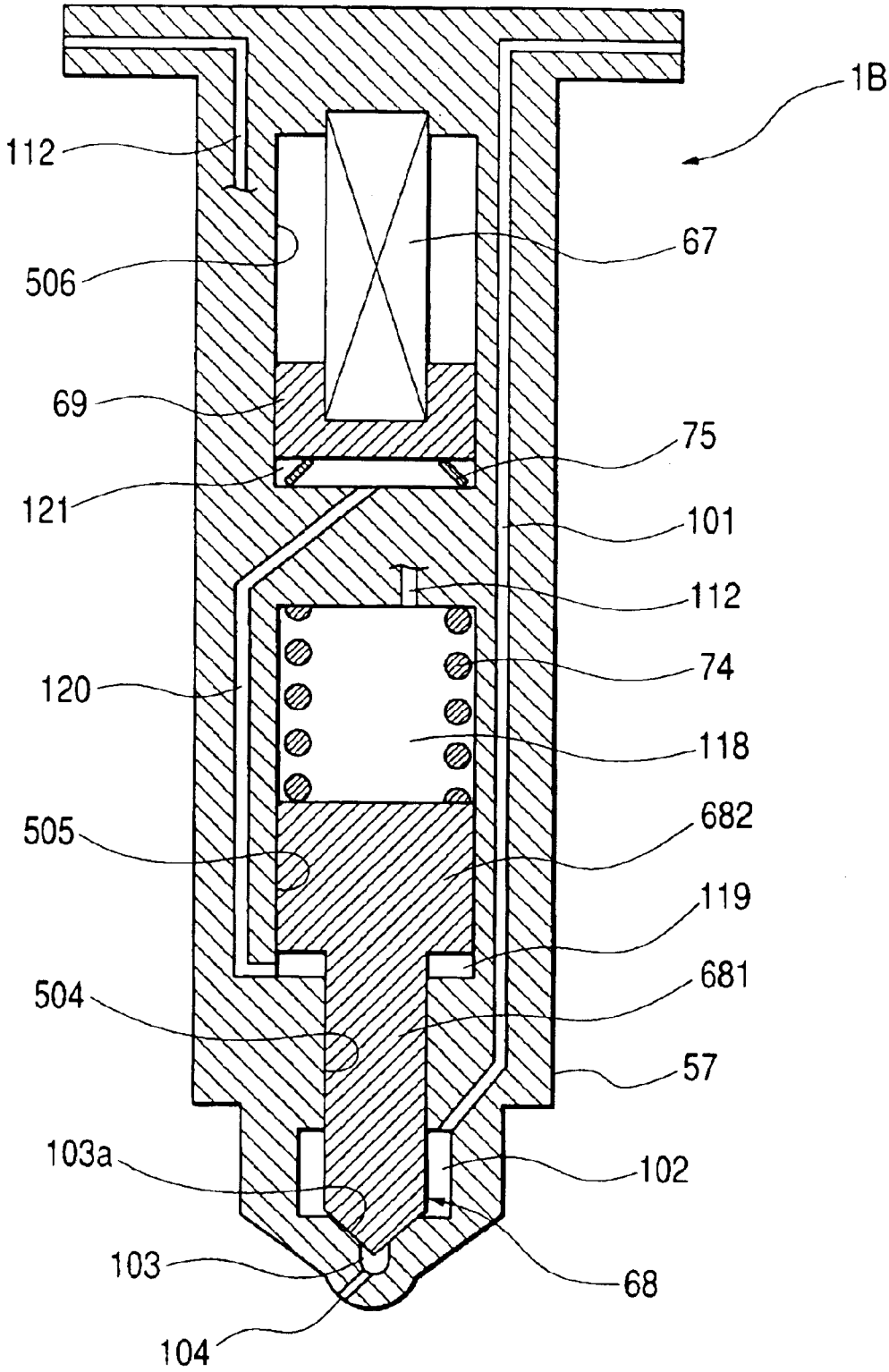
FIG. 10 is a cross sectional view showing a modification of the injector according to the second embodiment of the present invention.

Incidentally, in the aforementioned description, the piezoelectric actuator makes operate the hydraulic control valve of the injector, whereas the present invention may applied to the configuration such that the piezoelectric actuator generates the driving force of the injector's needle shown in FIG. 10. In FIG. 10, elements which substantially operate similarly to those in FIG. 3 are assigned to the same reference numbers of the elements in FIG. 3, thereby explaining mainly difference points therebetween.

As shown in FIG. 10, in the injector 1B, a needle guide cylinder 504 contains a needle 68. A vertical bore 505 continuing from the needle guide cylinder 504 is formed so as to be coaxially arranged to the needle guide cylinder 504 and a diameter of the vertical bore 505 is larger than that of the needle guide cylinder 504. A base portion 682 of the needle 68 projects into the vertical bore 505. The base portion 682 of the needle 68 has a diameter which is larger than that of a slide portion thereof, thereby being designed as a control piston 682. The control piston 682 is slidably supported in the vertical bore 505.

The vertical bore 505 is formed at an upper side of the control piston 682 with a spring chamber 118 in which a spring 74 is housed. The spring 74 is interposed between a top surface of the control piston 682 and a ceiling surface of the vertical bore 505 so as to continually urge the control piston 682 downwardly. The spring chamber 118 is communicated with a drain passage 112.

The vertical bore 505 is formed at a lower side of the control piston 682 with a control chamber 119 communicated through a communication passage 120 with a hydraulic chamber described later. A fuel pressure in the control chamber 119 urges upwardly the control piston 682, that is, the needle 68. Increasing and decreasing the fuel pressure in the control chamber 119 make the needle 68 lift and seat, and variably controls the lift of the needle 68.

The hydraulic chamber 121 is formed in a space of a vertical bore 506 in which a piezo piston 69 is held, space which is partitioned by the piezo piston 69. On opposite side through the piezo piston 69 of the hydraulic chamber 121 a piezoelectric actuator 67 is contained in the vertical bore 506 and can press the piezo piston 69. A dished spring 75 is disposed in the hydraulic chamber 121 so as to keep the control piston 682 and piezoelectric actuator 67 contact and always supply an initial load to the piezoelectric actuator 67.

According to the injector 1B, the piezoelectric actuator 67 is charged to press downwardly the piston 69 so that the hydraulic pressure in the hydraulic chamber 121 is increased. The increase of the hydraulic pressure is delivered to the control chamber 119, thereby being applied on a bottom surface of the control piston 682, causing the needle 68 to lift. The lift of the needle 68 causes the high pressure fuel to be injected from the hydraulic accumulator 102 through the suck portion 103. Discharging the piezoelectric actuator 67 makes reduce the piezoelectric actuator 67 so as to decrease the hydraulic pressure, causing the needle 68 to be seated again.

In this case of the injector 1B, the QR code is formed on the top surface of the connector portion (not shown) so that individual data of the respective injectors are read in the ECU. The individual data include the reference voltages V0 and the reference actuator temperatures T and they are obtained, after the injector 1B is installed in the engine, by performing the predetermined measurement of the respective injectors 1B. While the charging voltage is kept for a predetermined period, a minimum voltage is measured when a design maximum injection amount is obtained so that the minimum voltage is taken as a reference voltage V0. The operating state of injecting the maximum injection amount is a state such that the needle 68 keeps to a full lift position. Similarly to the injector 1A, the reference actuator temperature T0 is obtained according to the integrated value of the current and the reference actuator temperature T0.

A laser marks the reference voltage V0 and the reference actuator temperature T0 to the injector 1B as QR code and the QR code is written on the ROM of the ECU after the engine is assembled.

The ECU sets the target voltage according to the actuator temperature T, the common-rail pressure P and the operating state, thereby changing the lift amount of the needle 68, controlling the injection rate of the injector 1B in a high-precision. That is, when the engine operates at high speed and by a heavy load, the L is taken as L0 and the ECU takes the common-rail pressure P and the actuator temperature T so as to calculate a difference between the pressure P and the reference common-rail pressure P0 and that between the temperature T and the reference actuator temperature T0, respectively, thereby setting the target voltage in accordance with an equation similar to the equation (12). This permits the suitable energy amount to be supplied to the piezoelectric actuator 67, making the needle 68 the full lift state.

When the engine does not operate at high speed and by a heavy load, the L is taken as mL0, where the m provides a voltage when the predetermined injection amount which is smaller than the maximum injection amount is obtained with the needle 68 being kept at a half lift position. The voltage m is previously stored on the ECU. Similarly to the full lift operation, the ECU sets the target voltage according to the actuator temperature T and the common-rail pressure P, thereby supplying the suitable energy amount to the piezoelectric actuator 67, making the needle 68 lift by a predetermined lift amount so as to keep it to the half lift state.

Incidentally, in this modification, the reference voltage V0 must not be determined as a charging voltage when the maximum injection amount is obtained, whereas the reference voltage may be determined as a charging voltage in cases where the injection amount becomes 0. For example, while the charging voltage is kept for a predetermined period, a maximum voltage is measured under the reference common-rail P0, when the injection amount becomes 0 so that the maximum voltage is taken as a reference voltage V0'.

The ratio of the reference voltage V0' to the reference voltage by which the needle 68 moves to the full lift position, that is, the minimum voltage by which the design maximum injection amount is obtained under the reference common-rail pressure P is constant. Similarly, the ratio of the reference voltage V0' to the voltage by which the needle 68 moves to the half lift so that the predetermined injection amount is obtained is constant. The target voltages of the full lift state and the half lift state are obtained by setting the L to m1L0, and the L to m2L0. A voltage by which, while the charging voltage is kept for a predetermined period, a predetermined injection amount which is smaller than the maximum injection amount is obtained is determined as the reference voltage P0 so that the target voltage when keeping the needle 68 to the full lift may be set according to the ratio of the lift amount at the full lift state to that at the half life state.

Incidentally, in the injectors 1A and 1B, the predetermined operating state of each injector 1A, 1B during the measurement of the reference voltage is taken to one state even if the valve member 62 or the needle 68 is taken to a plurality of states including the full lift state and the half lift state, but, in the present invention, taking account of individual differences of injectors 1A (1B), the reference voltages may be obtained according to the plurality of operating states which have different lift amounts, such as the full lift state and the half lift state, so as to be stored on the ECU. In addition, the coefficient n or m may be given for each injector.

Moreover, the reference voltages are measured with respect to the plurality of operating states having different actuator temperatures T or different common-rail pressures P so that the predetermined operating state may be taken as the plurality of predetermined operating states having different actuator temperatures T or different common-rail pressures P. In this case, the control system may set the target voltage corresponding to the actual operating conditions by using, for example, interpolation correction.

Setting the coefficient n or m may permit the lift amount of the valve member or the needle to be gradually adjusted between the full lift position and the position to which the valve member or the needle is seated, thereby precisely controlling the drain amount from the injector 1A and the injection rate thereof during the depressurization control of the common-rail.

Moreover, in these descriptions, the piezoelectric actuator is used as the actuator, but an actuator capable of being deformed according to the energy kept therein by energization may be used. For example, a magnetostrictive actuator whose ferromagnetic material can be magnetized to deform may be used as the actuator.

In this case, the energy kept in the actuator determining the magnitude of magnetostriction of the magnetostrictive actuator, that is, the extension amount thereof depends on the current intensity flowing the solenoid of the magnetostrictive actuator, which forms the magnetic field for magnetization, so that the control system for controlling the magnetostrictive actuator controls the current as the energization content of the actuator. Then, even when causing the same current to flow each actuator, the magnetic fields formed by the magnetostrictive actuators are different from each other according to the individual differences of the magnetostrictive actuators, and substantial inductances of the solenoids are different from each other. This causes the extension amounts or the kept energies to vary among the hydraulic control valves or injectors.

Then, in the use of the magnetostrictive actuator, the ECU obtains current required for keeping energy needed in that the magnetostrictive actuator can make the hydraulic control valve or the injector the predetermined operating state so as to store the obtained current as the reference current in place of the reference voltage, thereby setting a target current in place of the target voltage according to the reference current. The target current may be obtained by correcting the reference current according to the actual operating conditions including the actuator temperature and so on. Even if the relationship between the energy and the current according to the variation of the operating conditions, it is possible to supply the suitable energy to the magnetostrictive actuator, depending on the variation.

This invention may be applied to an actuator device in which a piezoelectric actuator or a magnetostrictive actuator is installed, in place of the hydraulic control valve or the injector. In particular, the present invention may be more preferably applied to an actuator device which has complicated mechanisms and a hydraulic pressure interposed between the actuator and a movable member of the device.

In the actuator device, the operating conditions may not be limited to the actuator temperature, the load and the lift amount, and may be set according to each of objects to which the actuator device is applied on the basis of the individual differences of the injectors, environment factors affecting the operating characteristic of the actuator and so on.

While there has been described what is at present considered to be the preferred embodiments and modifications of the present invention, it will be understood that various modifications which are not described yet may be made therein, and it is intended to cover in the appended claims all such modifications as fall within the true spirit and scope of the invention.

What is claimed is:

1. A control system for controlling a plurality of actuator devices in each of which a piezoelectric actuator is installed, wherein each of said actuator devices comprises an high pressure port, a low pressure port and a movement member interposed between the high pressure port and the low pressure port, and is communicated with a common-rail, each of said piezoelectric actuators being deformed according to an amount of energy to displace the movement member between the high pressure port and the low pressure port, said energy being kept in each of the piezoelectric actuators by energization, said control system comprising:

means for storing thereon individual data each specifying a condition of the energization permitting energy to be supplied to each of the actuator devices, said energy being required for making each of the actuator devices a predetermining operating state, said condition of energization including a charging voltage of the piezoelectric actuator; and means for converting the individual data into actual data according to a difference between an actual operating condition of each of the actuator devices and a reference operating condition thereof, wherein said actual operating condition of each of the actuator devices includes an actual temperature of each of the actuator, an actual pressure in the common-rail and an actual displacement amount of the movement member, said reference operating condition includes a reference temperature of the actuator, a reference pressure in the common-rail, a reference actual displacement amount of the movement member and a reference voltage of the actuator, and wherein said converting means calculates difference values between the actual temperature and the reference temperature, between the actual common-rail pressure and the reference common-rail pressure and between the actual displacement amount and the reference displacement amount so as to calculate a target voltage by which the actuator is charged according to the calculated difference values and the reference voltage.

2. A control system for controlling a plurality of actuator devices according to claim 1, wherein said reference voltage and the reference temperature are measured from each of the actuator devices which operates under the reference common-rail pressure and the reference displacement amount so that the measured reference voltage and the reference temperature are stored on the storing means.

3. A control system for controlling a plurality of actuator devices according to claim 2, wherein said reference displacement corresponds to a displace amount of the movement member when it moves to a full lift position so that the movement member is seated to the high pressure port.

4. A control system for controlling a plurality of actuator devices according to claim 1, wherein said reference displacement corresponds to a displace amount of the movement member when it moves to a half lift position so that the movement member is located between the high pressure port and the low pressure port.

* * * * *